US007673538B2

(12) United States Patent
Choi

(10) Patent No.: US 7,673,538 B2
(45) Date of Patent: Mar. 9, 2010

(54) ADJUSTABLE PEDAL SYSTEM

(75) Inventor: Jin-Oh Choi, Gyeongsangbuk-do (KR)

(73) Assignee: SL Corporation, Daegu (KR)

( * ) Notice: Subject to any disclaimer, the term of this patent is extended or adjusted under 35 U.S.C. 154(b) by 641 days.

(21) Appl. No.: 11/591,385

(22) Filed: Nov. 1, 2006

(65) Prior Publication Data

US 2007/0137397 A1 Jun. 21, 2007

(30) Foreign Application Priority Data

Nov. 9, 2005 (KR) ..... 10-2005-0107125

(51) Int. Cl.
*G05G 1/30* (2008.04)

(52) U.S. Cl. ..... 74/512

(58) Field of Classification Search ..... 74/512, 74/513, 560

See application file for complete search history.

(56) References Cited

U.S. PATENT DOCUMENTS 2,464,873 A * 3/1949 Lear ..... 74/89.39
6,151,986 A 11/2000 Willemsen et al.
6,571,660 B2 * 6/2003 Gmurowski et al. ..... 74/512
6,782,776 B2 * 8/2004 Oberheide et al. ..... 74/512
7,051,613 B2 * 5/2006 Burton et al. ..... 74/512

FOREIGN PATENT DOCUMENTS

JP 8-22338 1/1996
JP 2001-278017 10/2001

* cited by examiner

*Primary Examiner*—Vicky A Johnson
(74) *Attorney, Agent, or Firm*—Edwards Angell Palmer & Dodge LLP

(57) ABSTRACT

Provided is a pedal system that can adjust control pedals on the basis of driver's physical conditions. The adjustable pedal system includes a support bracket that includes a guide groove formed in a substantially vertical direction and a predetermined hole, and is connected to a vehicle; a linear actuator that includes a drive arm linearly movable in a substantially vertical direction and applies a driving force to the drive arm; and a pedal arm. The pedal arm has a hinge hole that is connected to the drive arm by a first pin, a sliding slot that is connected to the predetermined hole by a second pin and is formed to be inclined with respect to the guide groove, and a pedal. The hinge hole is connected to the drive arm by a first pin, and the sliding slot is connected to the predetermined hole by a second pin and is formed to be inclined with respect to the guide groove. In this case, the portion of the pedal arm near the sliding slot slides with respect to the second pin, so that the position of the pedal arm can change.

10 Claims, 7 Drawing Sheets

ADJUSTABLE PEDAL SYSTEM

CROSS REFERENCE TO RELATED APPLICATION

This application claims priority from Korean Patent Application No. 10-2005-107125 filed on Nov. 9, 2005 in the Korean Intellectual Property Office, the disclosure of which is incorporated herein by reference in its entirety.

BACKGROUND OF THE INVENTION

1. Field of the Invention

The present invention relates to control pedals of an automobile, and more particularly, to control pedals that can be adjusted on the basis of driver's physique.

2. Description of the Related Art

For several years, makers or designers of automobiles have had an interest in ergonomic aspects for drivers with different physiques. An automotive control unit such as a steering wheel of an automobile is designed to be adjustable for the drivers with different physiques, so that the drivers with different physiques can drive the automobile. Since the driving comfort of the driver is an important factor, in respect to safety and ergonomics, the automotive control unit becomes very important.

Control pedals are commonly provided to a vehicle, and are stepped on by a driver's foot. The control pedals for a brake and an accelerator, which are separated from each other, are provided in the vehicle. If a vehicle is provided with a manual transmission, another control pedal used to drive a transmission clutch is provided in the vehicle. Front seats of the vehicle are configured to be movable along tracks to front and/or rear directions. However, by moving only the seat, it still does not sufficiently provide proper adjustment for a driver. Accordingly, there is a demand for a system that is used to adjust the positions of the control pedals so as to correspond to drivers with different physiques. This system is called an APS (Adjustable Pedal System).

An example of a system in the related art relating to the adjustable pedal system is disclosed in U.S. Pat. No. 6,571,660. The adjustable pedal system disclosed in U.S. Pat. No. 6,571,660 includes a support bracket, a pedal assembly, first and second pins, and a linear actuator. The support bracket is connected to a vehicle, and includes first and second slots that are spaced apart from each other and are not parallel to each other. The pedal assembly is disposed adjacent to the support bracket, and includes a pedal. The first and second pins are provided to the pedal assembly, and are inserted through the first and second slots, respectively. The linear actuator is connected to the pedal assembly so that the pedal assembly slides along the support bracket. The adjustable pedal system having the above-mentioned structure allows a driver to easily adjust the position of the pedal.

However, according to the slots and the pins, which cause the pedal assembly to slide along the support bracket, in the adjustable pedal system disclosed in U.S. Pat. No. 6,571,660, the slots are formed in the support bracket. Accordingly, the pedal assembly in the support bracket is exposed due to the slot formed in the support bracket. For this reason, there is a possibility that particles, fluid, and impurities enter the connection part between the pedal assembly and the pins coupled to the pedal assembly. This causes problems in the adjustable pedal system in that it is difficult to accurately control the adjustable pedal system.

In addition, the adjustable pedal system disclosed in U.S. Pat. No. 6,571,660 has been applied to one control pedal.

However, since a common vehicle includes at least two pedals (for example, an accelerator pedal and a brake pedal), to adjust each of the positions of the control pedals becomes complicated and there is a problem in that an actuator should be provided for each of the control pedals. Further, it is necessary for the accelerator pedal and the brake pedal to be interlocked with each other to be adjusted

SUMMARY OF THE INVENTION

An object of the present invention is to provide an adjustable pedal system in which a pedal assembly can be sealed by support brackets surrounding the pedal assembly.

Another object of the present invention is to provide an adjustable pedal system, which can interlock and adjust control pedals, and capable of being manufactured at a relatively low cost.

Objects of the present invention are not limited to those mentioned above, and other objects of the present invention will be apparent to those skilled in the art through the following description.

According to an aspect of the present invention, there is provided an adjustable pedal system including a support bracket that includes a guide groove formed in a substantially vertical direction and a predetermined hole, and is connected to a vehicle; a linear actuator that includes a drive arm linearly movable in a substantially vertical direction and applies a driving force to the drive arm; and a pedal arm. The pedal arm has a hinge hole that is connected to the drive arm by a first pin, a sliding slot that is connected to the predetermined hole by a second pin and is formed to be inclined with respect to the guide groove, and a pedal. In this case, the portion of the pedal arm near the sliding slot slides with respect to the second pin, so that the position of the pedal arm can change.

According to an aspect of the present invention, there is provided an adjustable pedal system including a linear actuator that includes first and second drive arms linearly movable in a substantially vertical direction and applies a driving force to the drive arms, a first support bracket that includes a first guide groove formed in a substantially vertical direction and a first hole and is connected to a vehicle, a brake pedal arm, a second support bracket that includes a second guide groove formed in a substantially vertical direction and a second hole and is connected to a vehicle, an accelerator pedal arm. The brake pedal arm includes a first hinge hole that is connected to the first drive arm by a first pin, a first sliding slot that is connected to the first hole by a second pin and is formed to be inclined with respect to the first guide groove, and a brake pedal. Further, the accelerator pedal arm includes a second hinge hole that is connected to the second drive arm by a third pin, a second sliding slot that is connected to the second hole by a fourth pin and is formed to be inclined with respect to the second guide groove, and an accelerator pedal. In this case, the portion of the brake pedal arm near the first sliding slot slides with respect to the second pin due to the movement of the first drive arm, so that the position of the brake pedal arm can change. In addition, the portion of the accelerator pedal arm near the second sliding slot slides with respect to the fourth pin due to the movement of the second drive arm, so that the position of the accelerator pedal arm can change.

Details of other embodiments of the present invention are included in the detailed description and drawings.

BRIEF DESCRIPTION OF THE DRAWINGS

The above and other features and advantages of the present invention will become more apparent by describing in detail preferred embodiments thereof with reference to the attached drawings, in which.

DESCRIPTION OF THE PREFERRED EMBODIMENTS

Figure 1:
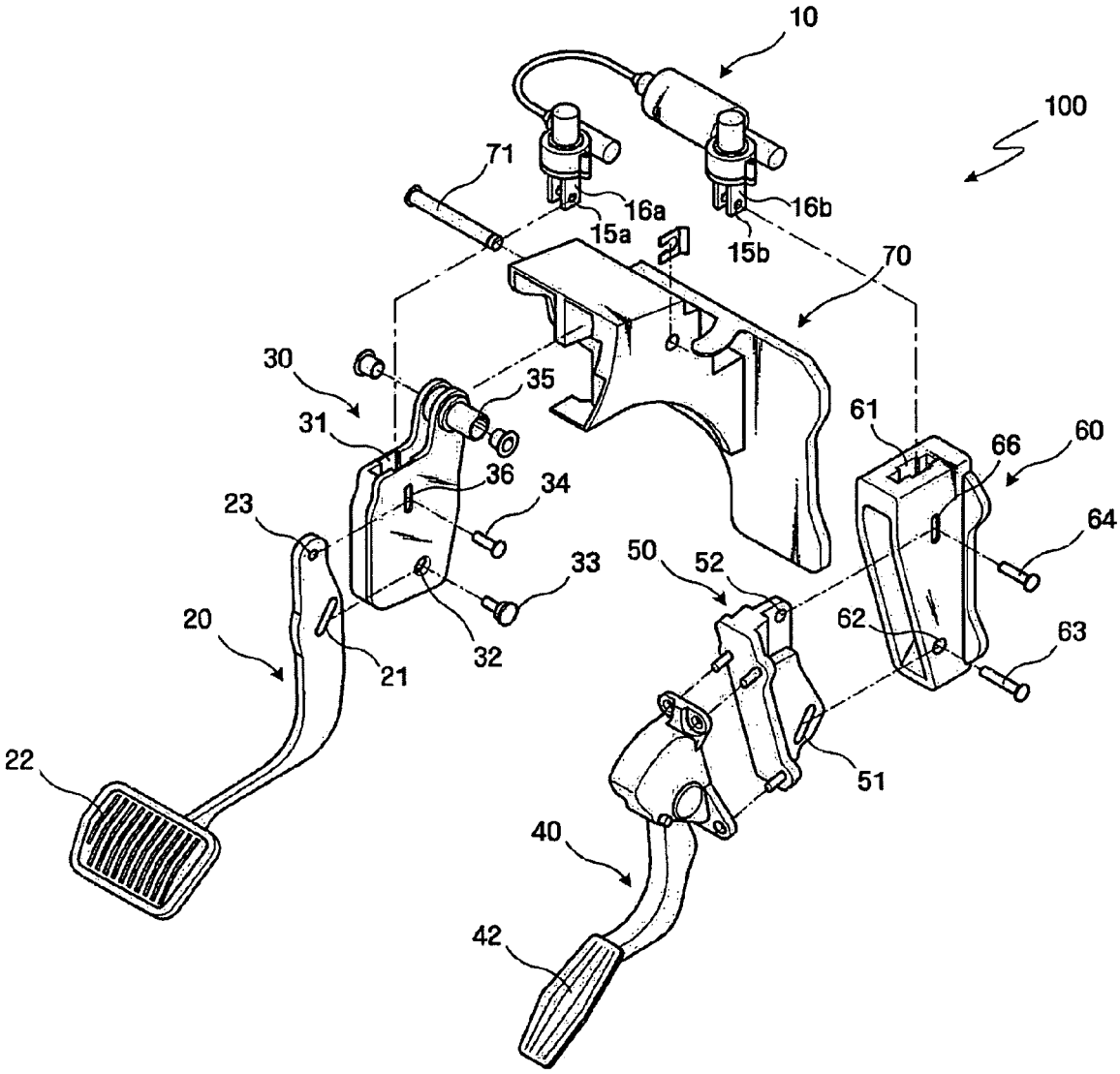
FIG. 1 is a view showing the structure of an adjustable pedal system according to an embodiment of the present invention.

Advantages and features of the present invention and methods of accomplishing the same may be understood more readily by reference to the following detailed descriptions of preferred embodiments and the accompanying drawings. The present invention may, however, be embodied in many different forms and should not be construed as being limited to the embodiments set forth herein. Like reference numerals refer to like elements throughout the specification.

Hereinafter, an embodiment of the present invention will be described in detail with reference to the accompanying drawings.

FIG. 1 is a view showing the structure of an adjustable pedal system according to an embodiment of the present invention. The adjustable pedal system 100 may include an actuator 10, a brake pedal arm 20, a first support bracket 30, an accelerator pedal arm 40, a connection plate 50, a second support bracket 60, and a main bracket 70. The adjustable pedal system 100 is provided with only two control pedals, that is, a brake pedal and an accelerator pedal in FIG. 1. However, the adjustable pedal system 100 may include a transmission clutch used as a third control pedal in addition to the above-mentioned components.

The brake pedal arm 20 includes a brake pedal 22 at the end thereof, and can rotate about a hinge hole 23 formed in the first support bracket 30. Further, when a vertical driving force is applied to the brake pedal arm 20 from the actuator 10, the brake pedal arm 20 is linearly moved along a sliding slot 21 formed in the brake pedal arm 20.

A first fixing pin 34 is inserted into the hinge hole 23 formed in the brake pedal arm 20 and two holes 15*a* formed in the drive arms 16*a* of the actuator 10, so that the brake pedal arm 20 is connected to the drive arms 16*a* of the actuator 10 in the first support bracket 30. The brake pedal arm 20 and the drive arms 16*a*, which are connected to each other by the first fixing pin 34, can be linearly moved along a guide groove 31, which is formed on the upper portion of the first support bracket 30, in a vertical direction. The first support bracket 30 may further include one or more vertical slots 36 at one side surface or both side surfaces thereof. The first fixing pin 34 is inserted through the vertical slots 36, and the vertical slots 36 additionally guide vertical movement of the drive arms 16*a*. However, the vertical slots 36 need not be formed in the first support bracket 30. In this case, a portion of the brake pedal arm 20 near the hinge hole 23, the first fixing pin 34, and the drive arms 16*a* are positioned in the guide groove 31 of the first support bracket 30.

Since the position of the hinge hole 23 can rotate about the first fixing pin 34 with respect to the drive arms 16*a*, the brake pedal arm 20 can rotate within a predetermined angle range.

A second fixing pin 33 is inserted into the sliding slot 21 and a hole 32, which is formed in the first support bracket 30 so as to correspond to the sliding slot 21, such that the brake pedal arm 20 and the first support bracket 30 are fixed to each other. As the sliding slot 21 is moved, the second fixing pin 33 can rotate within a predetermined angle range unlike the first fixing pin 34. The more detailed configuration of the second fixing pin 33 will be described with reference to FIG. 7.

The first bracket 30 is connected to the main bracket 70 so as to rotate at a predetermined angle with respect to the main bracket 70. A connection pin 71 may be inserted into the hinge hole 35 of the first bracket 30 so as to connect the first bracket 30 to the main bracket 70. Accordingly, when a driver steps on the brake pedal 22, the first bracket 30 can rotate about the connection pin 71 at a predetermined angle.

Meanwhile, the accelerator pedal arm 40, which includes an accelerator pedal 42 at the end thereof, may also have a similar configuration to the brake pedal arm 20. However, the accelerator pedal arm 40 is not directly connected to the second support bracket 60, and may be connected to the second support bracket 60 by the connection plate 50. The accelerator pedal arm 40 is fixed to the connection plate 50 by fastening members so as not to be able to move relative to the connection plate 50. Further, like the brake pedal arm 20, the accelerator pedal arm 40 may be directly connected to the second support bracket 60 without the connection plate 50. In this case, a sliding slot 51 should be formed in the accelerator pedal arm 40. In addition, the connection plate 50 and the accelerator pedal arm 40 may be integrated with each other so as to form one accelerator pedal arm.

The accelerator pedal arm 40 and the connection plate 50 can rotate about a hinge hole 52. Further, when a vertical driving force is applied to the accelerator pedal arm 40 from the actuator 10, the accelerator pedal arm 40 can move along a sliding slot 51 formed in the accelerator pedal arm 40.

A third fixing pin 64 is inserted into the hinge hole 52 formed in the connection plate 50 and two holes 15*b* formed in the drive arms 16*b* of the actuator 10, so that the connection plate 50 is connected to the drive arms 16*b* of the actuator 10 in the second support bracket 60. The brake pedal arm 20 and the drive arms 16*a*, which are connected to each other by the third fixing pin 64, can be linearly moved along a guide groove 61, which is formed on the upper portion of the second support bracket 60, in a vertical direction. The second support bracket 60 may further include one or more vertical slots 66 at one side surface or both side surfaces thereof. The third fixing pin 64 is inserted through the vertical slots 66, and the vertical slots 66 additionally guide vertical movement of the drive arms 16*b*. In this case, the vertical slots 66 need not be formed in the second support bracket 60 like the vertical slots 36.

Since the position of the hinge hole 52 can rotate about the third fixing pin 64 with respect to the drive arms 16*b*, the accelerator pedal arm 40 can rotate within a predetermined angle range.

A fourth fixing pin 63 is inserted into the sliding slot 51 and a hole 62, which is formed in the second support bracket 60 so as to correspond to the sliding slot 51, such that the connection plate 50 and the second support bracket 60 are fixed to each other. The fourth fixing pin 63 may have a similar configuration to the second fixing pin 33.

When the actuator 10 having the configuration of FIG. 1 operates, a pinion gear provided to the actuator 10 rotates and the drive arms 16*a* are moved downward. As a result, the brake pedal arm 20 including the hinge hole 23, which is connected to the holes 15*a* of the drive arms 16*a* by the first fixing pin 34, is moved downward along the guide groove 31 of the first support bracket 30. In this case, the brake pedal arm 20 is linearly moved along the oblique sliding slot 21, and thus is moved forward. Since the accelerator pedal arm 40 also operates as described above, the description of the operation of the accelerator pedal arm 40 will be omitted to avoid repetition.

Figure 2:
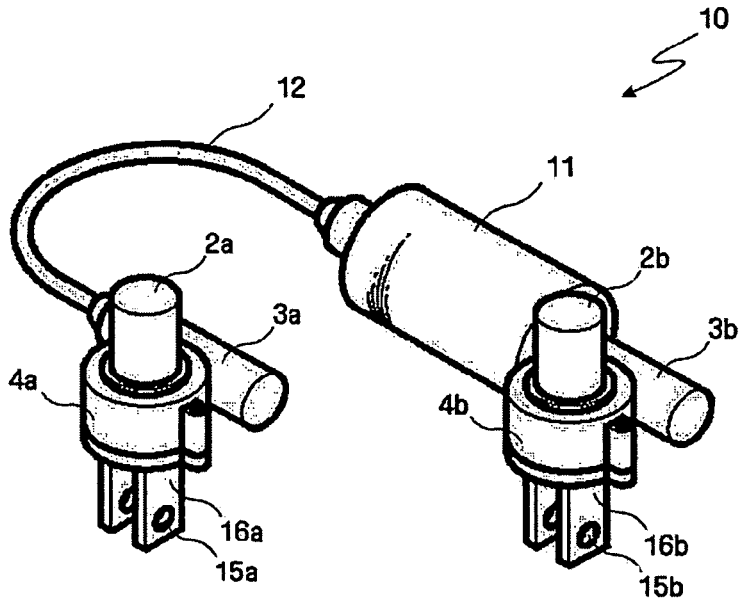
FIG. 2 is a view showing an actuator of the system shown in FIG. 1.

FIG. 2 is a view showing the actuator 10 of the above-mentioned system 100. The actuator 10 includes a rotary motor 11, worm gear housings 3*a* and 3*b*, pinion housings 4*a* and 4*b*, drive arms 16*a* and 16*b*, screw housings 2*a* and 2*b*, a hard wire 12. The worm gear housings 3*a* and 3*b* receive worm gears directly or indirectly connected to the rotary motor 11, respectively. The pinion housings 4*a* and 4*b* receive pinion gears engaged with the worm gears. The drive arms 16*a* and 16*b* are connected to the pinion gears by the screws. The screw housings 2*a* and 2*b* receive the protruded portions of the screws from the upper surfaces of the pinion gears. The hard wire 12 is used for remote transmission of the power from the motor.

Figure 3:
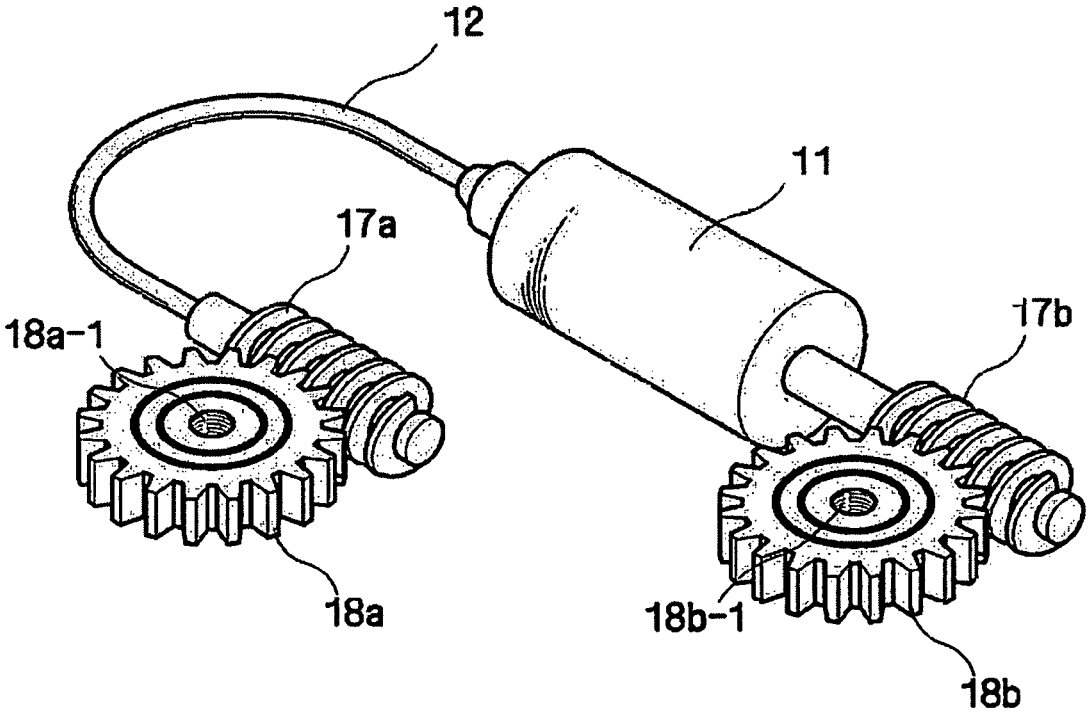
FIG. 3 is a view illustrating the driving principle of the actuator.

Referring to FIG. 3, the motor 11 is indirectly connected to a first worm gear 17*a* by the hard wire 12, and is indirectly connected to a second worm gear 17*b*. The hard wire 12 is a component used to remotely transmit the torque of the motor to the first worm gear 17*a*. If the motor 11 can be directly connected to the first worm gear 17*a* in terms of the structure, the first worm gear 17*a* may also be directly connected to the motor 11.

In any case, the torque of the motor 11 is transmitted to the first worm gear 17*a* and the second worm gear 17*b*, and the first worm gear 17*a* and the second worm gear 17*b* are engaged with a first pinion gear 18*a* and a second pinion gear 18*b*, respectively. Accordingly, a speed ratio is determined depending on a gear ratio between each worm gear and each pinion gear. Predetermined threads 18*a*-1 and 18*b*-1 are formed at the centers of the pinion gears 18*a* and 18*b*, respectively, so that the screws are engaged with the threads of the pinion gears 18*a* and 18*b*, respectively.

Figure 4:
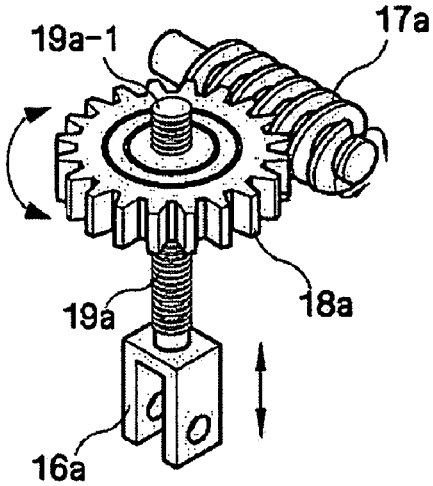
FIG. 4 is a view showing a mechanism for converting the rotational motion of a motor into the linear motion of a drive arm.

FIG. 4 is a view showing a basic mechanism of the actuator 10 according to the embodiment of the present invention. When the worm gear 17*a* rotates, the pinion gear 18*a* also rotates on the basis of a predetermined gear ratio. As a result, a jackscrew 19*a* engaged with the thread 18*a*-1, which is formed at the center of the pinion gear 18*a*, is moved in a vertical direction due to the rotation of the pinion gear 18*a*. The reason for this is that the drive arm 16*a* integrated with the jackscrew 19*a* cannot rotate due to the first fixing pin 34. Accordingly, the jackscrew 19*a* can move only in the vertical direction with respect to the pinion gear 18*a*, such that the length of a portion 19*a*-1 of the jackscrew 19*a* that protrudes from the upper surfaces of the pinion gear 18*a* is variable. For this reason, the screw housing 2*a* is designed so as to receive the protruded portion 19*a*-1 even when the portion 19*a*-1 has the maximum length.

In the mechanism shown in FIG. 4, assuming that the speed ratio of the pinion gear to the worm gear is l/n and the pitch of the screw is represented by p, the moving distance of the drive arm 16*a* is p/n when the motor rotates one revolution. It is possible to minutely control the drive arm 16*a* by using the above-mentioned relationship.

Figure 5:
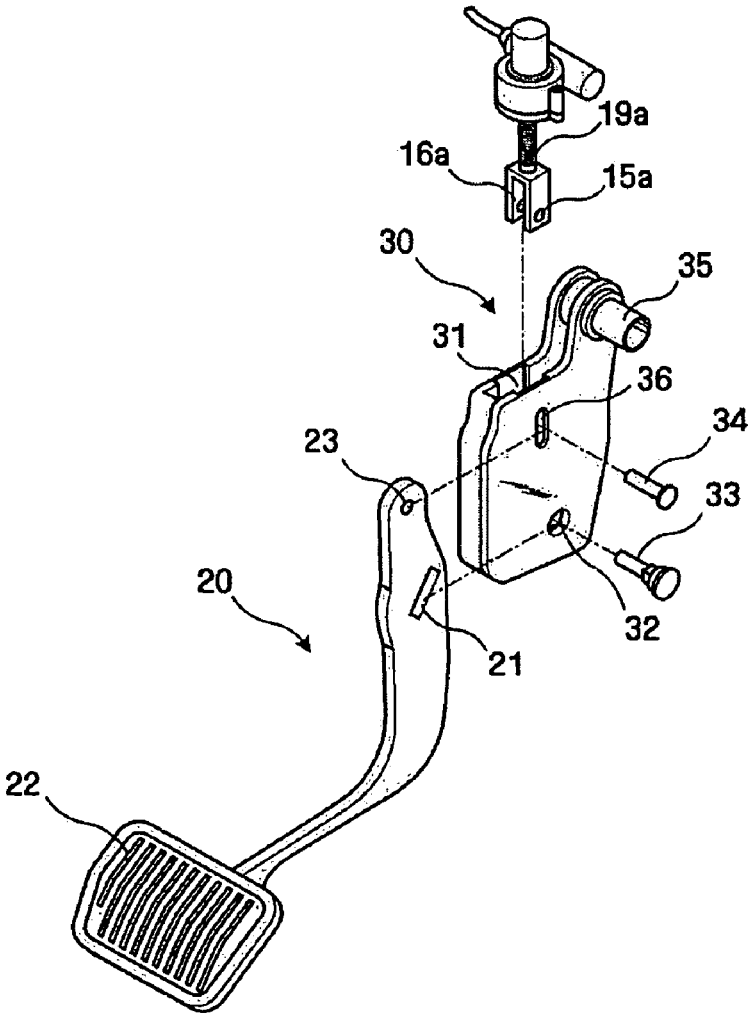
FIG. 5 is a view showing structure in which an actuator, a first support bracket, and a brake pedal arm are connected.

Referring to FIG. 5, the drive arm 16*a* is connected to the first support bracket 30 by the first fixing pin 34, and then positioned in the guide groove 31. In this case, since the first support bracket 30 is formed of two plates separated from each other, the two plates are fixed to each other using predetermined fastening members.

When the jackscrew 19*a* of the actuator 10 is linearly moved downward, a force caused by the jackscrew 19*a* is transmitted to the drive arm 16*a*. As a result, the portion of the hinge hole 23 is moved downward.

Figure 6:
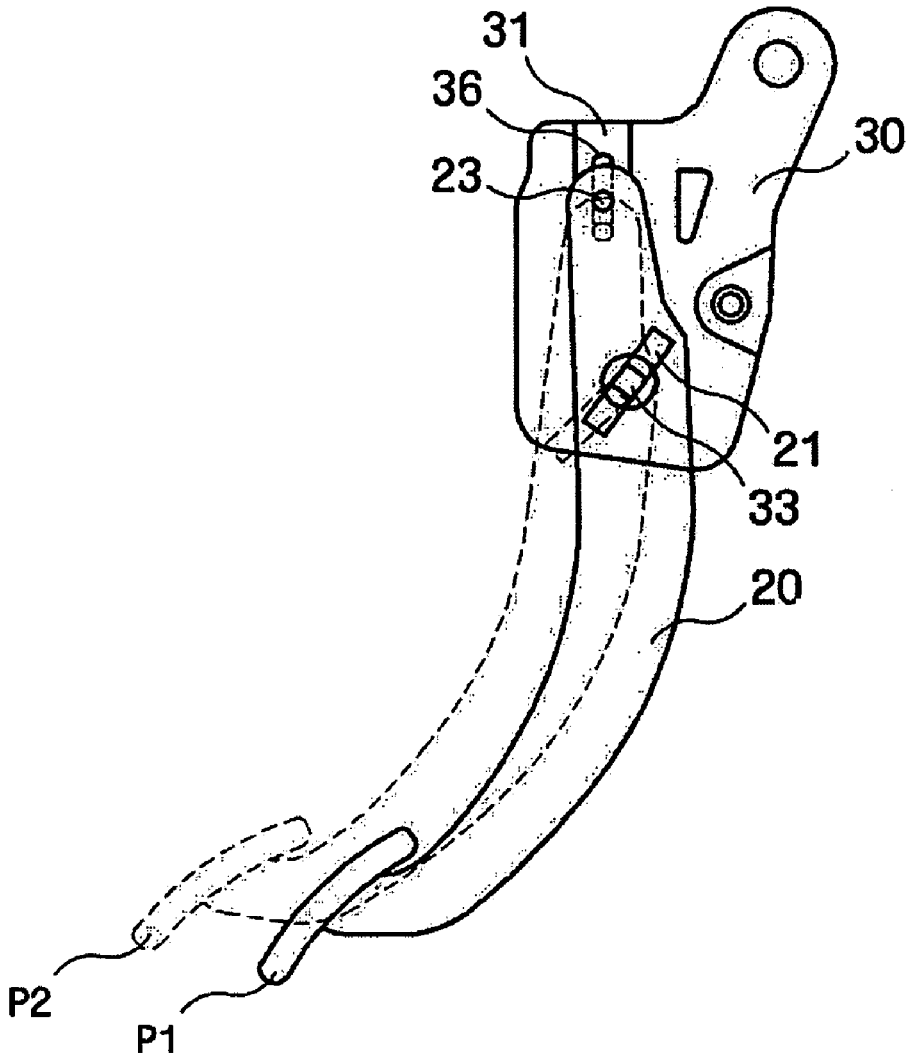
FIG. 6 is a view showing when the position of the brake pedal arm is changed.

FIG. 6 is a side view showing the brake pedal arm 20 and the first support bracket 30 when one of the two plates of the first support bracket 30 is omitted. Referring to FIG. 6, when the portion of the brake pedal arm 20 near the hinge hole 23 is moved downward, the second fixing pin 33 is linearly moved in respect to the sliding slot 21. However, since the second fixing pin 33 can only rotate and cannot be linearly moved, the portion of the brake pedal arm 20 near the sliding slot 21 is moved downward in an oblique direction. For this reason, the pedal 22 attached to the brake pedal arm 20 is moved from position P1 to position P2, that is, is moved forward. When the jackscrew 19*a* is moved upward on the basis of the above-mentioned operational principle, the pedal 22 is moved backward.

Figure 7:
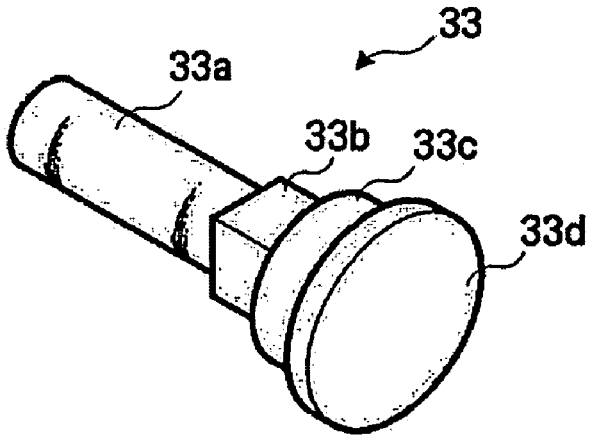
FIG. 7 is a view showing detailed shapes of a second fixing pin and a fourth fixing pin.

FIG. 7 is a view showing the detailed structure of a second fixing pin 33 according to the embodiment of the present invention. The second fixing pin 33 may include a central shaft 33*a* inserted through the first support bracket 30, a rectangular prism 33*b* inserted into the sliding slot 21, a cylinder 33*c* inserted into the hole 32, and a flange 33*d* for preventing the second fixing pin 33 from being moved in an axial direction. Accordingly, the height of the rectangular prism 33*b* is substantially equal to the width of the sliding slot 21, and the diameter of the cylinder 33*c* is substantially equal to that of the hole 32. In this case, there is a clearance between the rectangular prism 33*b* and the sliding slot 21 so that the rectangular prism 33*b* is linearly moved in respect to the sliding slot 21. Further, there is a clearance between the cylinder 33*c* and the hole 32 so that the cylinder 33*c* rotates in respect to the hole 32.

Figure 8:
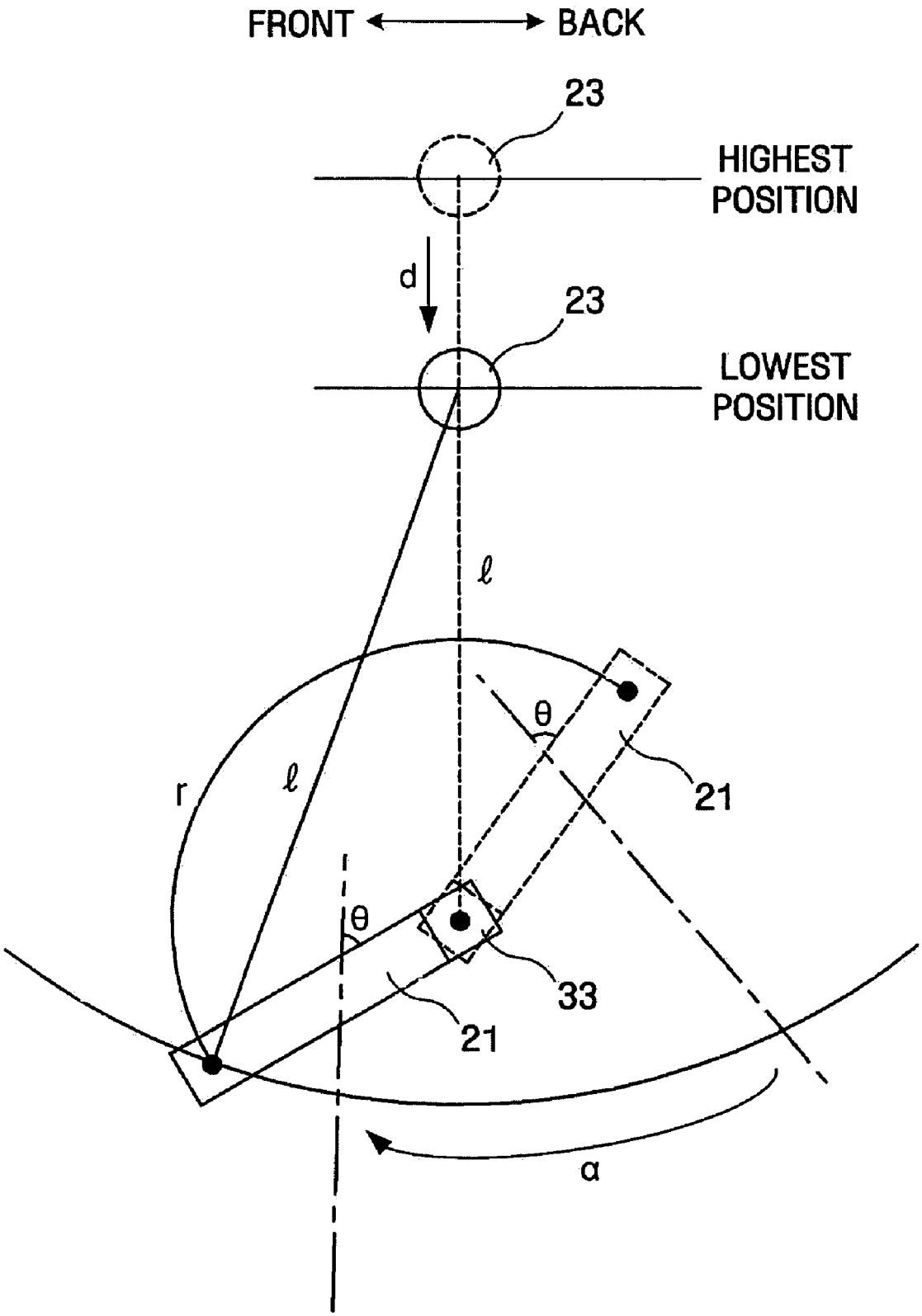
FIG. 8 is a diagram geometrically showing positions and angles of the brake pedal arm based on the descent of the drive arm.

FIG. 8 is a diagram geometrically showing the motion of the brake pedal arm 20 according to the embodiment of the present invention. Since the brake pedal arm 20 is a rigid body, a distance between the hinge hole 23 and a predetermined position in the sliding slot 21 and an angle θ between the sliding slot 21 and the brake pedal arm 20 do not change.

When the hinge hole 23 is positioned at the highest position, the rectangular prism 33*b* of the second fixing pin 33 is positioned at the front end of the sliding slot 21. In this case, a distance between the center of the hinge hole 23 and the center of the rectangular prism 33*b* is referred to as l. When the position of the hinge hole 23 is moved downward by d so as to be positioned at the lowest position, the position of the sliding slot 21, that is, the position of the brake pedal arm 20 may be obtained as follows: when the position of the hinge hole 23 is positioned at the lowest position, an intersection between a circle that uses the center of the hinge hole 23 as the center thereof and has a radius l and a circle that uses the center of the rectangular prism 33*b* as the center thereof and has a radius r (the length of the slot—the width of the rectangular prism 33*b*) is a forefront position at which the center of the rectangular prism 33*b* can be positioned. In this case, it is understood that the rectangular prism 33*b* slightly rotates.

Referring to FIG. 8, when the position of the hinge hole 23 is moved from the highest position to the lowest position, the brake pedal 22 rotates forward by an angle of a while being moved downward slightly. When the angle θ of the sliding slot 21, the effective length r of the sliding slot, and the effective length d of the guide groove 31 are appropriately adjusted on the basis of the above-mentioned geometrical relationship, it is possible to obtain a maximum angle or distance in which the pedal 20 can be moved.

Figure 9:
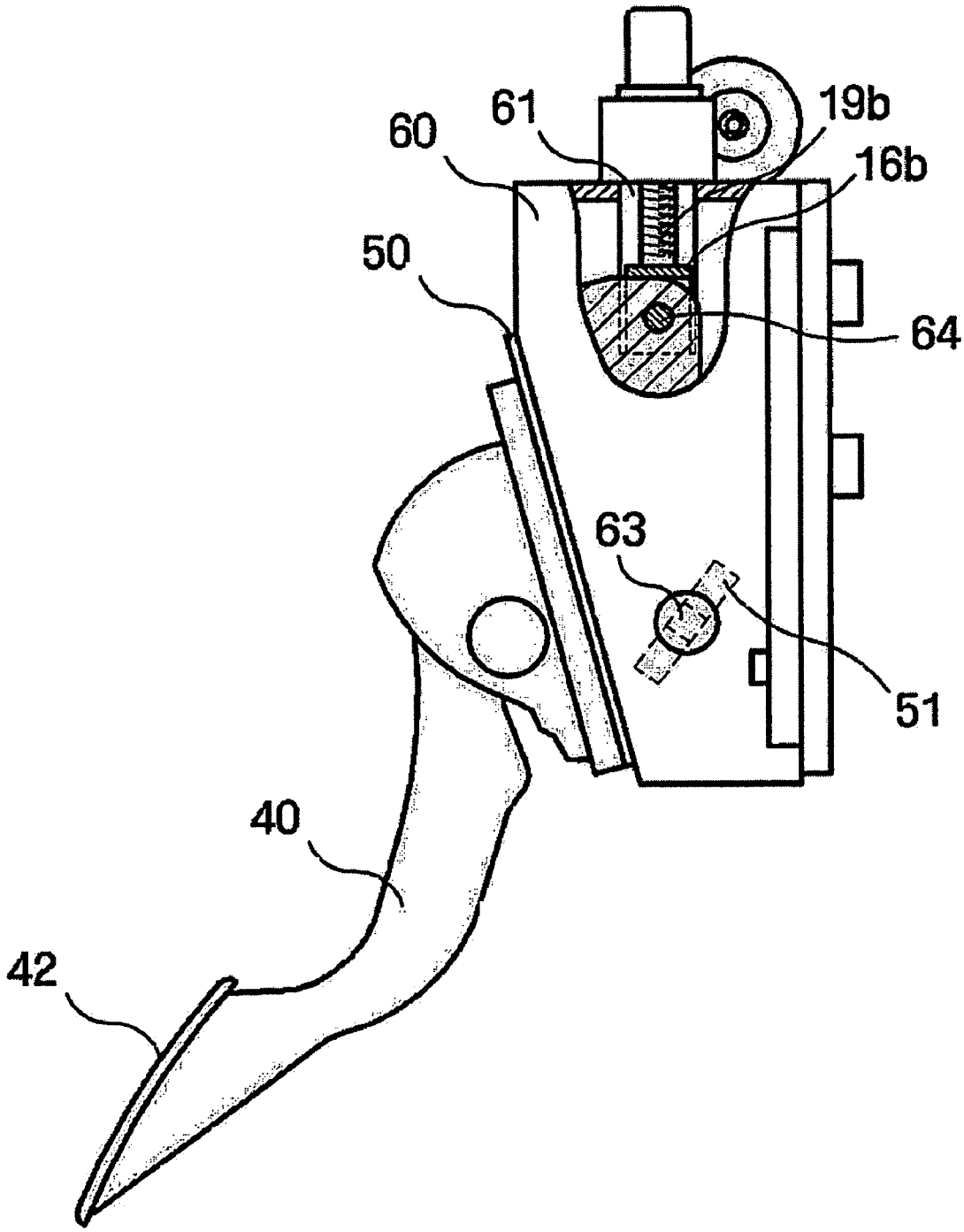
FIG. 9 is a view showing the structure of an accelerator pedal assembly according to an embodiment of the present invention.

Meanwhile, the accelerator pedal is also adjustable like the brake pedal. Referring to FIG. 9, when the jackscrew 19*b* and the drive arm 16*b* are moved downward along the guide groove 61 formed on the upper portion of the second support bracket 60, the position of the sliding slot 51 of the connection plate 50 received in the second support bracket 60 is moved downward and forward. As a result, the brake pedal arm 40 and the brake pedal 42 are moved. In the same manner, when the position of the hinge hole 52 is moved upward, the brake pedal 42 is moved upward and backward.

Figure 10:
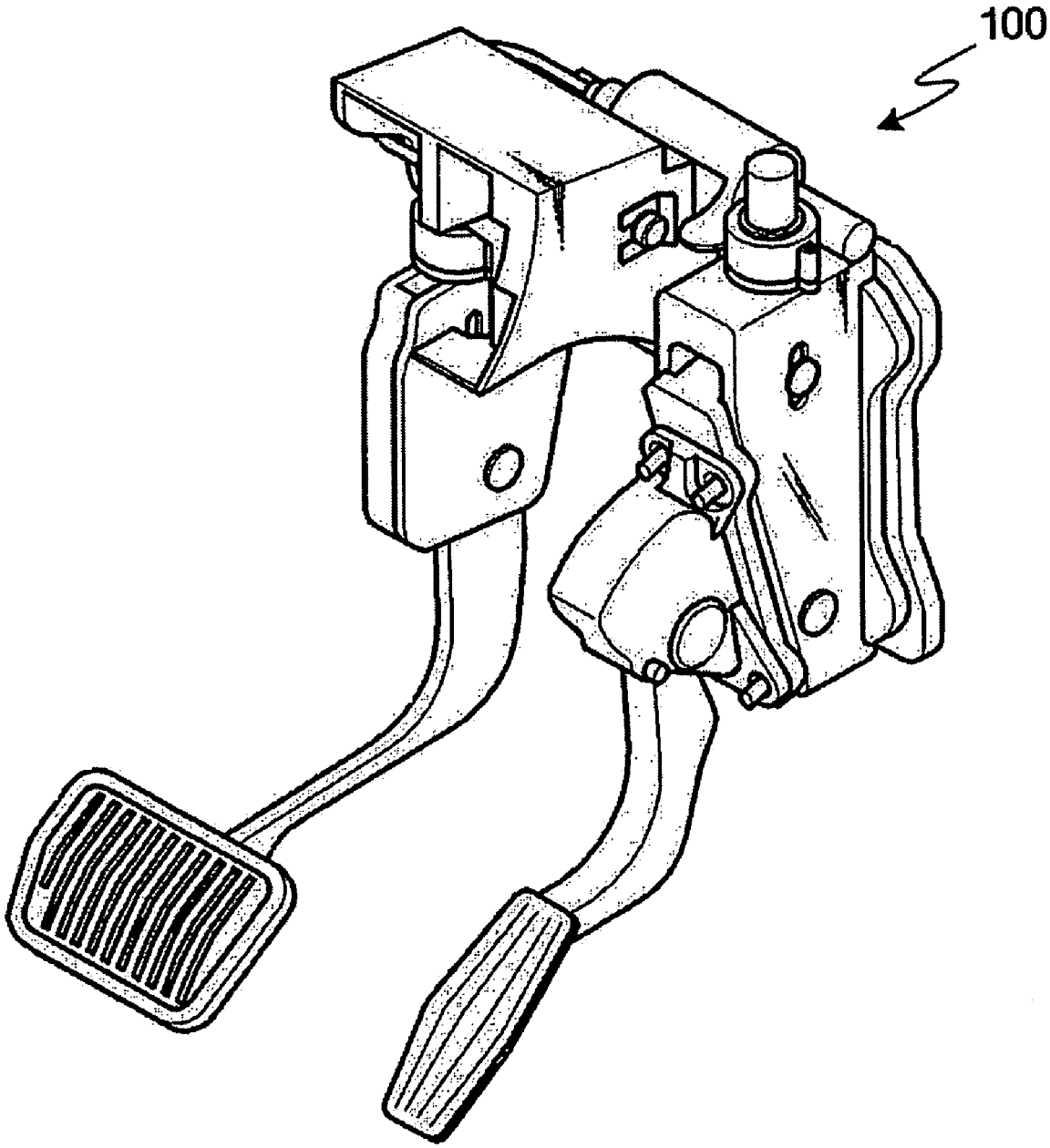
FIG. 10 is a view showing the adjustable pedal system, which is completely assembled, according to the embodiment of the present invention.

FIG. 10 is a view showing the adjustable pedal system 100, which is completely assembled, according to the embodiment of the present invention. As shown in FIG. 10, the adjustable pedal system 100 does not include a vertical slot that is used to guide vertical movement of the drive arm and a sliding slot in which the pedal arm rotates, on the support brackets 30 and 60, unlike the related art. For this reason, the inside and outside of the support brackets 30 and 60 are effectively sealed. As a result, the adjustable pedal system 100 can be relatively free from outside impurities such as particles.

In addition, according to the embodiment of the present invention, since each of the drive arms 16*a* and 16*b* is moved using one motor so as to easily adjust each of the control pedals, the control pedals can be interlocked with each other so as to be adjusted. If a driver selects the desired position of the brake pedal, the accelerator pedal is also adjusted accordingly. The reason is because one motor can drive the drive arms 16*a* and 16*b* by using the structure as shown in FIG. 3.

The brake pedal and the accelerator pedal, which are moved by the drive arms, may be adjusted so as to have different moving distance and angle, by the above-mentioned structure. For example, when the position of the brake is significantly different for each driver, but the position of the accelerator is slightly different for each driver, as compared to the brake, the speed ratio of the first pinion gear to the first worm gear may be set to be different from the speed ratio of the second pinion gear to the second worm gear in the structure shown in FIG. 3. As a result, it is possible to obtain the above-mentioned characteristic.

The adjustable pedal system according to the embodiment of the present invention may further include an electronic circuit that is pre-programmed and stores set values of the control pedals based on the user's selection. The electronic circuit may be formed of appropriate means, for example, a location transducer such as a voltage divider or encoder. The optional memory means is a computer module that may be integrated with the motor or may be separate from the motor. The electronic circuit may detect the positions of the control pedals or pedal arms, and may transmit signals corresponding to the detected positions to the computer module.

In the above description, only the brake pedal and accelerator pedal have been described as examples of the control pedals. However, it should be understood that the above-mentioned structure may be applied to a transmission clutch pedal. The adjustable pedal system according to the embodiment of the present invention may be typically applied to automobiles. However, the adjustable pedal system is not limited to automobiles, and may also be applied to any vehicle that includes trucks, aircrafts, and the like.

Although the present invention has been described in connection with the exemplary embodiments of the present invention, it will be apparent to those skilled in the art that various modifications and changes may be made thereto without departing from the scope and spirit of the present invention. Therefore, it should be understood that the above embodiments are not limitative, but illustrative in all aspects.

The adjustable pedal system according to the embodiment of the present invention can have the following advantages. That is, the adjustable pedal system may have the simple and solid structure as described above, and can prevent outside impurities from entering the support bracket from outside of the support brackets that surround the pedal assembly. In addition, according to the adjustable pedal system, it is possible to obtain an advantage that the control pedals are interlocked with each other and are adjusted.

Further, the adjustable pedal system has the structure in which through slots are not formed in the support brackets. Accordingly, since a sealed space is formed in the support bracket, it is possible to solve the problem caused by entrance of foreign substances from the outside.

Furthermore, since the adjustable pedal system according to the embodiment of the present invention can have simple and small structure as compared to the adjustable pedal system in the related art, it is possible to efficiently use the space in the vehicle.

What is claimed is:

1. An adjustable pedal system comprising:

a support bracket comprising one or more vertical slots at one side surface or both side surfaces thereof, a guide groove formed in a substantially vertical direction and a predetermined hole, the support bracket being connected to a vehicle;

a linear actuator comprising a drive arm that is linearly moved in a substantially vertical direction, the linear actuator applying a driving force to the drive arm; and a pedal arm comprising a hinge hole that is connected to the drive arm by a first pin, a sliding slot that is connected to the predetermined hole by a second pin and is formed to be inclined with respect to the guide groove, and a pedal, wherein the portion of the pedal arm near the sliding slot slides with respect to the second pin due to the movement of the drive arm, so that the position of the pedal arm can change; and wherein the first pin is inserted through the vertical slots, so that the vertical slots and the guide groove additionally guide vertical movement of the drive arm.

2. The adjustable pedal system of claim 1, wherein the actuator further comprises: a motor; a worm gear rotated by the motor; a pinion gear engaged with the worm gear; and a jackscrew that is engaged with a thread formed at the center of the pinion gear and is connected to the drive arm.

3. The adjustable pedal system of claim 2, wherein the first pin is inserted into a hole formed in the drive arm and the hinge hole, so that the pedal arm is connected to the drive arm.

4. The adjustable pedal system of claim 1, wherein the pedal is one of a brake pedal, an accelerator pedal, and a transmission clutch pedal.

5. The adjustable pedal system of claim 1, wherein the second pin rotates at a predetermined angle.

6. The adjustable pedal system of claim 1, wherein the second pin comprises a rectangular prism that is inserted into the sliding slot.

7. An adjustable pedal system comprising:

a linear actuator including first and second drive arms that are linearly movable in a substantially vertical direction, the linear actuator applying a driving force to the drive arms;

a first support bracket including one or more vertical slots at one side surface or both side surfaces thereof, a first guide groove formed in a substantially vertical direction and a first hole, the first support bracket being connected to a vehicle;

a brake pedal arm including a first hinge hole that is connected to the first drive arm by a first pin, a first sliding slot that is connected to the first hole by a second pin and is formed to be inclined with respect to the first guide groove, and a brake pedal;

a second support bracket including one or more vertical slots at one side surface or both side surfaces thereof, a second guide groove formed in a substantially vertical direction and a second hole, the second support bracket being connected to a vehicle; and an accelerator pedal arm including a second hinge hole that is connected to the second drive arm by a third pin, a second sliding slot that is connected to the second hole by a fourth pin and is formed to be inclined with respect to the second guide groove, and an accelerator pedal, wherein the portion of the brake pedal arm near the first sliding slot slides with respect to the second pin due to the movement of the first drive arm, such that the position of the brake pedal arm can change, and the portion of the accelerator pedal arm near the second sliding slot slides with respect to the fourth pin due to the movement of the second drive arm, such that the position of the accelerator pedal arm can change;

wherein the first pin is inserted through the vertical slots of the first support bracket, so that the vertical slots and the guide groove additionally guide vertical movement of the drive arm; and wherein the third pin is inserted through the vertical slots of the second support bracket, so that the vertical slots and the guide groove additionally guide vertical movement of the drive arm.

8. The adjustable pedal system of claim 7, wherein the actuator further comprises: a motor; first and second worm gears rotated by the motor; first and second pinion gears engaged with the first and second worm gears, respectively; and first and second jackscrews that are engaged with threads formed at the centers of the first and second pinion gears and are connected to the first and second drive arms, respectively.

9. The adjustable pedal system of claim 7, wherein at least one of the first and second worm gears is connected to the motor by a hard wire.

10. The adjustable pedal system of claim 7, wherein a speed ratio of the first pinion gear to the first worm gear is adjusted to be different from a speed ratio of the second pinion gear to the second worm gear, so that a moving distance of the brake pedal is different from a moving distance of the accelerator pedal.

* * * * *